US006851936B2

(12) United States Patent
Stingel et al.

(10) Patent No.: US 6,851,936 B2
(45) Date of Patent: Feb. 8, 2005

(54) VACUUM PRODUCING DEVICE

(75) Inventors: Jürgen Stingel, Stuttgart (DE); Volker Quendt, Unterensingen (DE)

(73) Assignee: Festo AG & Co., Esslingen (DE)

( * ) Notice: Subject to any disclaimer, the term of this patent is extended or adjusted under 35 U.S.C. 154(b) by 131 days.

(21) Appl. No.: 10/231,406

(22) Filed: Aug. 29, 2002

(65) Prior Publication Data

US 2003/0044287 A1 Mar. 6, 2003

(30) Foreign Application Priority Data

Aug. 30, 2001 (EP) ..... 01120843

(51) Int. Cl.[7] ..... F04F 5/44

(52) U.S. Cl. ..... 417/198; 417/182; 417/187; 294/64.1; 294/64.2

(58) Field of Search ..... 417/198, 185, 417/192, 196, 187; 294/64.2, 64.1

(56) References Cited

U.S. PATENT DOCUMENTS

| | | | | |
|---|---|---|---|---|
| 2,784,989 A | | 2/1957 | Reynolds | 294/64 |
| 4,380,418 A | | 4/1983 | Crawford et al. | 417/87 |
| 4,549,854 A | * | 10/1985 | Yamamoto | 417/187 |
| 4,810,170 A | * | 3/1989 | Ide | 417/194 |
| 4,865,521 A | * | 9/1989 | Ise et al. | 417/187 |
| 4,880,358 A | * | 11/1989 | Lasto | 417/174 |
| 5,007,803 A | | 4/1991 | DiVito et al. | 417/130 |
| 5,887,623 A | * | 3/1999 | Nagai et al. | 137/884 |
| 6,575,705 B2 | * | 6/2003 | Akiyama et al. | 417/198 |

FOREIGN PATENT DOCUMENTS

| | | |
|---|---|---|
| DE | 38 18 381 A | 12/1988 |
| EP | 61 004900 | 1/1986 |

* cited by examiner

*Primary Examiner*—Justine R. Yu
*Assistant Examiner*—William H. Rodriguez
(74) *Attorney, Agent, or Firm*—Hoffmann & Baron, LLP

(57) ABSTRACT

A vacuum producing device having an ejector means with a jet nozzle and a receiving nozzle downstream from it. At the outlet end of the receiving nozzle there is a receiving space for the fluid flowing through the receiving nozzle and an exit flow duct extends from it. The exit flow duct is provided with choke means for resetting or variably setting the fluid volumetric flow, leaving by way of the exit flow duct, in order to be able to affect the pressure obtaining in the receiving space.

23 Claims, 1 Drawing Sheet

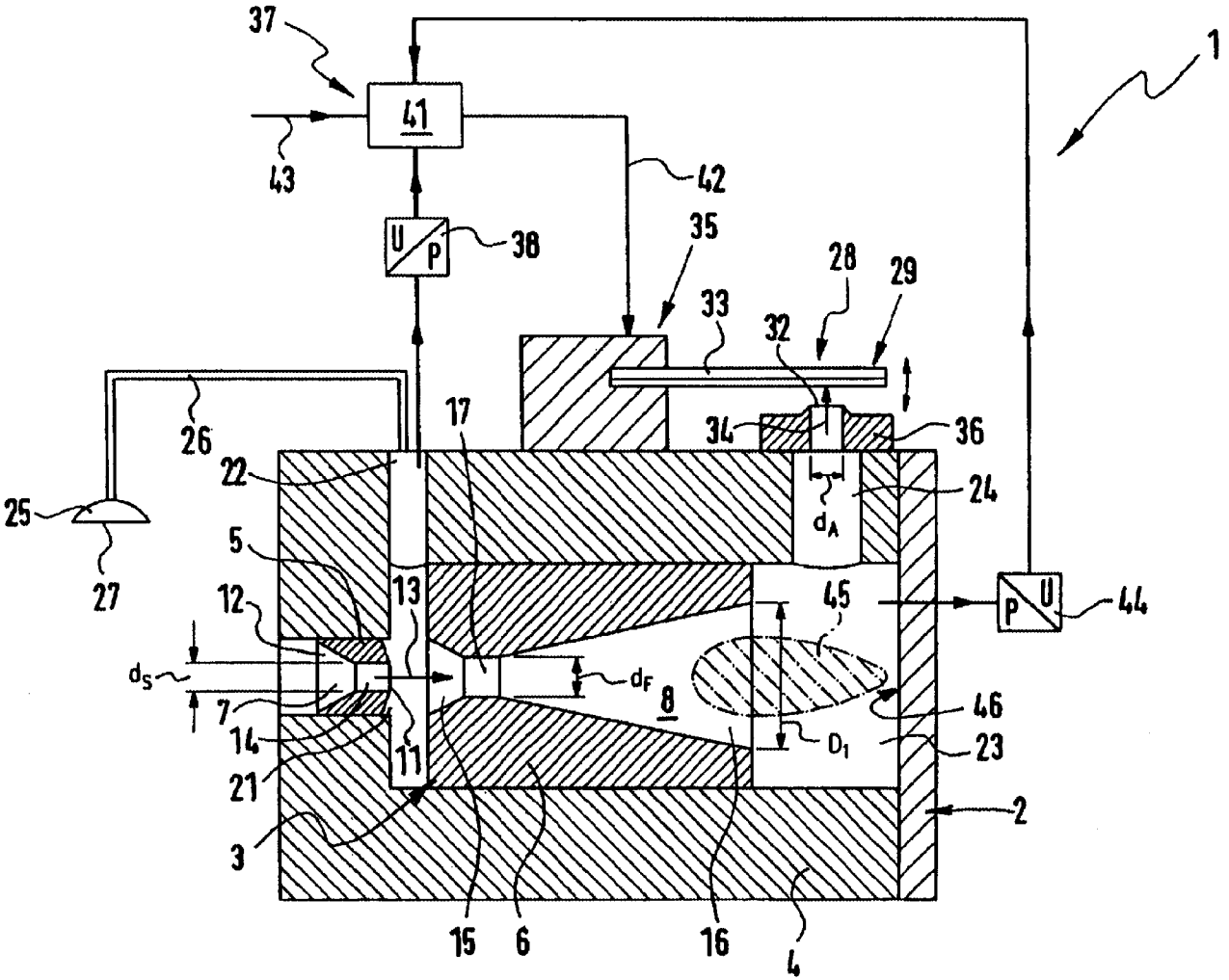
1
2
3
4
5
6
7
8
11
12
13
14
15
16
17
21
22
23
24
25
26
27
28
29
32
33
34
35
36
37
38
41
42
43
44
45
46
U
P
$d_A$
$D_1$
$d_F$
$d_S$

VACUUM PRODUCING DEVICE

BACKGROUND OF THE INVENTION

The invention relates to a vacuum producing device comprising at least one ejector device, having a jet nozzle with a receiving nozzle placed downstream from it and furthermore with a draw off zone defined in the transition zone between the jet nozzle and the receiving nozzle, a receiving space being present at the outlet end of the receiving nozzle, said receiving space serving for the fluid flowing through the receiving nozzle, an exit flow duct leading off from the said space, and furthermore means for influencing the fluid flow through the exit flow duct.

THE PRIOR ART

The German patent publication 4,302,951 C1 discloses such a vacuum producing device, in whose housing, adjoining the outlet end of the receiving nozzle, a receiving space is arranged, which receives fluid flowing out of the receiving nozzle and from which the fluid may flow by way of an adjoining exit flow duct into the surrounding atmosphere. A piston runs in the receiving space and is able to be shifted selectively between an open position permitting flow through the exit flow duct and a closed position in which the exit flow duct is completely closed. In order to maintain vacuum in the draw off zone the piston assumes the open position and renders possible unhindered exit flow of the fluid coming from the receiving nozzle. If the piston is in the closed position, the fluid passing through the receiving nozzle is directed to the draw off zone, where it overcomes the vacuum.

Vacuum producing devices are frequently employed in materials handling, in which case an exit flow duct, which is connected with the draw off duct, leads to a suction gripper, which may be applied to an article to be handled. In order to hold the article on the suction gripper, a suitably high degree of vacuum is produced in the draw off duct. For releasing the article again the vacuum is cut.

If when using such conventional vacuum producing device different articles are being handled, differing for example in size and/or consistency and/or weight, the cutting of the vacuum caused for releasing the article frequently fails to meet requirements. In some the circumstances an article is not released quickly enough or the article may be too strongly jolted on release.

In order to address this type of problem there has already been a proposal in the German patent publication 3,818,381 A1 to join the draw off zone by way of a separate venting duct with the surroundings, such duct being able to be selectively turned off or on by means of a control valve. Furthermore, on the venting duct a compressed air regulating valve is provided having different settings. The amount of design complexity needed in this system is however relative large.

SHORT SUMMARY OF THE INVENTION

One object of the invention is to provide a vacuum producing device rendering it possible to influence of the pressure obtaining in the draw off zone using simple means.

In accordance with one possible design of the invention this object is achieved by using a resettable choke means for variably setting the volumetric fluid flow leaving by way of the exit flow duct for the purpose of influencing the pressure obtaining in the receiving space.

As means for influencing the fluid flow through the exit flow duct choke means are accordingly provided, which render possible a variable setting of the volumetric fluid flow. This particular setting will control a pressure level in the receiving space associated with the outlet end of the receiving nozzle, such pressure causing a greater or lesser back pressure in the fluid flowing through the receiving nozzle. It has been discovered that with such an influence on the fluid flow through the receiving nozzle working pressures may be produced in the draw off zone which differ in accordance with needs in order, for instance, to kill the vacuum in a manner dependent on the type of articles being handled or in a manner dependent on the working site, i.e. on the application.

It has also been more especially discovered that the choke effect occurring in the exit flow duct downstream from the receiving space permits an extremely exact setting of the working pressure obtaining in the draw off zone and that merely a small flow cross section of the exit flow duct is required for this. This means that there is now the possibility of employing choke means characterized by small dimensions, low actuating forces and a low power requirement.

This concept also forms the basis of the further possibility in accordance with the invention of a provision that while the exit flow duct's rated diameter ($d_A$), as measured at the minimum cross section of the duct, should be larger than the jet nozzle's rated diameter ($d_S$), as measured at the minimum cross section of the jet nozzle duct, said exit flow duct's rated diameter ($d_A$) it is however smaller than receiving nozzle's rated diameter ($d_F$) as measured at the minimum cross section of the receiving nozzle duct.

This dimensioning or selection of the diameter does involve advantages furthermore in cases in which, as a means for influencing the fluid flow through the exit flow duct no choke means are provided and instead for example simple shut off means are employed, which with a sort of digital behavior selectively render possible either a complete opening or a complete closing of the exit flow duct.

Further advantageous developments of the invention are defined in the claims.

The choke means may be in principle so designed that they permit a stepped variation in the volumetric fluid flow. However it is more advantageous to employ a design, in the case of which the choke means render possible a stepless variation of the volumetric fluid flow, something leading to an optimum setting of the working pressure in the draw off zone.

The choke means preferably comprise a control member able to be positioned in different choke settings in relation to the exit flow duct. The control member is more particularly associated with an exit flow opening of the exit flow duct, such opening being located at the end region of the exit flow duct opposite to the receiving space, that is to say for instance clear of the exit flow duct. The control member may be placed opposite to the exit flow opening of the exit flow duct.

A particularly simple way of varying the choke effect intensity is possible, if the control is shifted to be at a greater or lesser distance from the exit flow opening to get the desired choke setting.

In order to define the exit flow opening it is possible to provide an exit flow nozzle, there being the possibility in the case of a interchangeable arrangement, of using exit flow nozzles with different cross sectional sizes.

If the control member is a component of an electrically operated setting device designed for constant or progressive action, then it is possible for the desired volumetric flow and accordingly the pressure obtaining in the receiving space to be preset in a particularly simple and accurate fashion. In the case of the setting device it is preferably a question of a proportional setting device. The principle of functioning of the setting device is more particularly based on electromagnetic and/or piezoelectric principles of operation.

More particularly if the vacuum producing device is equipped for operation with compressed air as the respective fluid, it is to be recommended to so design the exit flow duct that it opens into the surrounding atmosphere.

The various designs in accordance with the invention of the vacuum producing device also provide the possibility of freely selecting the shape of the exit flow duct and the placement of the exit flow opening. This means that the structural features of the vacuum producing device and more particularly of the features of the particular application thereof may be taken into account without any difficulties. There is more especially the possibility of having a configuration of the exit flow duct which is aligned with the longitudinal direction of the receiving nozzle or which extends from the side. Thus for instance the exit flow opening may be placed to the side in order to minimize the longitudinal dimensions of the vacuum producing device.

By using suitable control and/or regulating means it is possible to provide for a controlled or regulated setting of the working pressure obtaining in the draw off zone. To take an example, by employment of a suitable regulation means it is possible to ensure that any desired working pressure may be set, which, irrespectively of the application of the vacuum producing device, for example independently of the air pressure obtaining, may be supplied with a constant parameter.

In the design of the vacuum producing device it is moreover recommended to so select the dimensions of the receiving space that a supersonic flow zone, established at the outlet end of the receiving nozzle, is not obstructed by the limiting walls of the receiving space. This means that an extremely good efficiency may be obtained.

DETAILED ACCOUNT OF WORKING EMBODIMENT OF THE INVENTION

In the following a preferred embodiment of the invention will be described in the form of a vacuum producing device, illustrated in the accompanying drawing mainly in longitudinal section.

The vacuum producing device generally referenced 1 comprises at least one vacuum producing unit 2, which is provided with at least one ejector means 3, by which a vacuum or suction pressure may be produced.

In the working embodiment illustrated the ejector means 3 is accommodated in a housing 4 forming part of the vacuum producing unit 2. It comprises a jet nozzle 5 and a receiving nozzle 6 placed downstream from same. The jet nozzle 5 and the receiving nozzle 6 are independent components in the present working example, which however could readily be designed in the form of an integral unit, for example as a cartridge-like structural unit.

The jet nozzle 5 has a jet nozzle duct 7 extending through it. A receiving nozzle duct 8 extends through the receiving nozzle, it preferably being aligned coaxially with the jet nozzle duct 7.

During operation of the vacuum producing device 1 the ejector means 3 is supplied with a fluid subject to a supply pressure through the inlet opening 12 of the jet nozzle duct 7. The supply pressure may for instance be of the order of 5 bar. The fluid is preferably a gaseous fluid and more especially compressed air.

The supplied fluid passes through jet nozzle duct 7, whose cross section tapers in the flow direction 13 as indicated by an arrow. The diameter, as measured at the minimum cross section 14, of the jet nozzle duct 7 will be termed the jet nozzle duct's rated diameter $d_S$.

After passage through the jet nozzle duct 7 the fluid will flow by way of an inlet opening 15 into the receiving nozzle duct 8, passes through same in the axial direction and comes out at the opposite end by way of outlet opening 16 from the receiving nozzle duct 8. The receiving nozzle duct 8 has a point of minimum cross section 17, which is associated with the inlet opening 15, the diameter here being termed the receiving nozzle duct's rated diameter $d_F$. Starting at the point with the minimum cross section 17 the cross section of the receiving nozzle duct 8 waxes toward the outlet opening 16, the diameter measured here being termed the receiving nozzle duct's outlet diameter $D_1$.

The inlet opening 15 of the receiving nozzle duct 8 is arranged in the flow direction 13 at some distance from the outlet opening 11 of the jet nozzle duct 7. This means that a zone, termed the draw off zone, 21 is located in the transition zone between the jet nozzle 5 and the receiving nozzle 6, and is connected with a draw off duct 22 running out of the housing 4.

At the outlet end of the receiving nozzle 6, and preferably directly adjoining the outlet opening 16 of the receiving nozzle duct 8, a receiving space 23 is located in the housing 4 of the vacuum producing unit 2, such space 23 serving for the fluid leaving through the receiving nozzle 6. From this point there extends an exit flow duct 24, which extends through the wall of the housing 4 and preferably opens into the surrounding atmosphere of the vacuum producing unit 2.

During operation of the vacuum producing device 1 the fluid flowing through the jet nozzle 7 and the adjoining receiving nozzle 6 causes a suction effect in the draw off zone 21 so that here a vacuum may be produced which is dependent on the design of the ejector means 3. This vacuum can be tapped at the draw off duct 22. In the working embodiment illustrated such tapping is a diagrammatically indicated suction gripper 25 connected by way of an intermediately placed suction line 26.

The suction gripper 25 for example comprises one or more suckers or suction plates with at least one suction opening 27, it being able to be laid against the object with this suction opening 27 to the fore so that the object may be handled and for example lifted. Owing to the suction effect of the ejector means 3 a vacuum is formed in the suction gripper 25 as well, such vacuum meaning that the respective object is held and for instance may be raised.

The fluid flowing out from the receiving nozzle duct 8 at the end can first expand in the following receiving space 23 and may then flow through the exit flow duct 24 to the atmosphere.

The exit flow duct 24 is provided with means, with which the fluid flow in the exit flow duct 24 may be influenced. These flow influencing means, generally referenced 28 in the drawing, are preferably designed in the form of choke means 29, with which variable setting, i.e. resetting, of the fluid's volumetric flow in the exit flow duct 24 may be established.

The choke effect is preferably produced at an exit flow opening 32, which defines the minimum cross section, termed the draw off duct's 22 rated diameter $d_A$, and is preferably located at the outer terminal region of the exit flow duct 24 opposite to the receiving space 23.

In accordance with the instantaneous setting of the choking intensity a variable exit flow pressure is set in the receiving space 23. The level of the exit flow pressure acts on the fluid flow in the receiving nozzle duct 8, since with an increase level it causes an increasing back pressure in the receiving nozzle duct 8. This means that the flow through the receiving nozzle duct 8 is reduced and accordingly also the working pressure currently existing in the draw off zone 21 by the choke means.

Assuming a fluid flow influenced to a minimum extent through the outlet duct 24, a working pressure will result in the draw off zone 21, which corresponds to the maximum possible vacuum. There is then the possibility of taking hold of an object to be handled in the above mentioned manner using the suction gripper 25.

In order to lay down the handled object again, the working pressure obtaining in the suction gripper 25 is increased. This increase in pressure may be caused by corresponding operation of the choke means 29. A maximum working pressure can be set, when the choke means 29, acting like a shut off valve, closes the exit flow opening 32 and accordingly the exit flow duct 24 completely. The entire quantity of fluid flowing in by way of jet nozzle 5 is then passed by way of the draw off zone 21 to the suction gripper 25. This gives rise to a gage pressure pulse which causes laying down of the object which has so far been held.

Owing to the variable setting, i.e. resettability, of the choke means 29 there is furthermore a possibility of variably setting or resetting the exit flow pressure between the minimum pressure value obtaining with a minimum choke action and the maximum pressure value obtaining when the exit flow duct 24 is completely shut off. This is performed simply by choking of the fluid flowing out through the exit flow duct 24. There is accordingly the possibility of variably setting the working pressure obtaining in the draw off zone 21 in accordance with requirements and more particularly of setting the pressure increase, necessary for the depositing an object lifted by the suction gripper 25, to an optimum value. It is in this manner that it is for instance possible to take into account the size and weight of the objects to be handled. It is possible to prevent a relatively light object, as for instance a printed circuit board, not being deposited in the appropriate gentle manner, so that no objects will be roughly handled.

In the working embodiment illustrated the choke means 29 comprise a control member 33 which may be set in different choke position in relation to the exit flow duct 24. Owing to the possibility of changing the position it is more particularly possible to vary the relative position between the control member 33 and the exit flow opening 32 placed at the outer end of the exit flow duct 24.

The control member 33 is opposite to the exit flow opening 32 preferably in the exit flow direction 34 as indicated by the arrow. Dependent on the selected choke setting there will be a smaller or larger distance of the control member 33 from the exit flow opening 32. The control member functions as a sort of back pressure member.

The working example shows a design in which the control member 33 is constituted by the piezoelectric flexural element of a setting device 35 on the basis of a piezoelectric effect or function. Dependent on the voltage applied to the control member 33 there will be a larger or smaller flexural displacement, the control member 33 preferably being able to be positioned in an desired setting between two extreme positions, preferably steplessly. The one extreme position is indicated in the drawing, where the control member 33 is spaced to a maximum extent from the exit flow opening 32 so that exiting fluid is not affected or is only affected to a small extent. In the other extreme position the control member 33 is deflected to such an extent that it completely covers the exit flow opening 32, the exit flow opening 32 having a valve seat around it if necessary in order to ensure a reliable sealing action.

It is an advantage if the exit flow opening 32 is defined by a exit flow nozzle 36. Such exit flow nozzle 36 is preferably a component separate from the housing 4 and is more especially attached to the housing in an interchangeable manner.

If there is an interchangeable arrangement of the exit flow nozzle 36 the vacuum producing unit 2 may if necessary selectively be fitted with exit flow nozzles 36 of different rated diameters $d_A$ in order to have adaptation to the possible vacuum performance of the ejector means 3.

In the working embodiment illustrated the exit flow duct 24 contains an inner duct section, extending through the housing 4, which opens in the interior into the receiving space 23 and on whose outer end the exit flow nozzle 36 may be mounted, which defines an outer duct section including the exit flow opening 32 of the exit flow duct 24. Because the inner duct section is designed with the maximum possible cross section, it is possible to set the maximum exit flow cross section available simply by changing the exit flow nozzle.

It has surprisingly been found that the function of the vacuum producing unit 2 is not impaired even if the exit flow duct's rated diameter $d_A$ is substantially less than the receiving nozzle duct's outlet diameter $D_1$. This means that there is the possibility of designing the exit flow opening $D_1$ without reductions in performance with a relatively small cross section, something which further means that the choke means 29 and more particularly the control means 33 may be manufactured to be lighter in weight and cheaper. This furthermore applies not only for piezoelectric setting means but also for setting means on the basis of other functional principles, as for example those functioning electromagnetically.

In order to obtain the above mentioned stepless setting of the fluid's volumetric flow through the exit flow duct 24, the setting means 35 is preferably designed for continuous or progressive action. In the working embodiment illustrated it is a question of a proportional setting device, in the case of which the deflection of the control member 33 is proportional to the applied control voltage.

In the working embodiment illustrated the exit flow duct's rated diameter $d_A$ is so selected that it is larger than the jet nozzle duct's rated diameter $d_S$ and is furthermore smaller than the receiving nozzle duct's rated diameter $d_F$.

It is convenient for the exit flow duct's rated diameter $d_A$ to be only slightly larger than the jet nozzle duct's rated diameter $d_S$.

In any case there is the possibility of selecting the rated diameter $d_A$ of the exit flow duct separately from the receiving duct's exit diameter $D_1$. Accordingly it is possible to control a substantially smaller exit flow opening than would be the case, if the choking of the flow were to be performed directly at the receiving nozzle duct's exit diameter $D_1$.

Furthermore the exit flow duct's rated diameter $d_A$ is best made substantially smaller than the receiving nozzle duct's rated diameter $d_F$.

The receiving nozzle duct's exit flow diameter $D_1$ is preferably in all cases larger than the three above mentioned rated diameters $d_S$, $d_F$ or $d_A$.

Owing to the separate selection of the exit flow opening 32 and of the receiving nozzle 6 there is furthermore the possibility of selecting the form of the exit flow duct 24 and the placement of the exit flow opening 32 practically without any limitation. If a slim structure is desired, it is possible for the exit flow duct, as related to the longitudinal direction of the receiving nozzle 6, to run out in the same direction for example. If a short design is aimed at, the exit flow duct 24 may, as for example as illustrated in drawing, start at the side and more particularly have a n exit flow opening 32 aligned laterally in relation to the longitudinal axis of the receiving nozzle 6.

The vacuum producing device 1 is preferably provided with control and/or regulation means 37, which render possible an actuation of the choke member 29 in a manner dependent on the working pressure obtaining in the draw off zone.

The control and/or regulation means 37 preferably have a first pressure sensor 38, by which the working pressure obtaining in the draw off zone 21 is detected and supplies pressure signals, preferably electrical ones, as an actual or true value to a control unit 41. After comparison of the actual values with a predetermined desired value the control zone 41 then passes suitable electrical drive signals to the setting device 35. The transmission of the drive signals is indicated in the drawing at 42. The desired or target values are preferably predetermined with a possibility of resetting them, this being indicated at 43.

In the case of one possible manner of operation the desired value is applied to the control unit 41, which may be a conventional controller. The control unit 41 then ensures, by way of a suitable control of the control member 33, that the exit flow cross section, which is available for the fluid at the exit flow duct 24, is so changed dynamically that the desired working pressure is established. This working pressure is so high that an object may be reliably gripped by the suction gripper 25.

In order to then lay down the object, a change of desired value then takes place in the control unit 41 in order to produce a laying down or deposit pulse. Again by suitable drive of the control member 33 a dynamic change of the exit flow cross section available at the exit flow duct 24 causes the working pressure to be reset in a highly dynamic manner—more particularly within a few milliseconds—to the desired gage pressure.

In order to improve the accuracy and dynamic properties of regulation there is the possibility of having an additional, combined regulation of the exit flow pressure obtaining in the receiving space 23. For this purpose the control and/or regulation means 37 may comprise a second pressure sensor 44 for the pressure obtaining receiving space 23 and which sends corresponding pressure signals to the control unit 41.

The ejector means 3 can be designed either for subsonic flow or for ultrasonic flow. In the case of one design for supersonic flow it is to be recommended to so select the dimensions of the receiving space 23 that a supersonic flow zone 45 formed at the exit flow end of the receiving nozzle 6 is not obstructed by the limiting walls of the receiving space 23. More particularly, the length of the receiving space 23 as measured in the longitudinal direction of the receiving nozzle duct 8, is so selected that the supersonic flow zone 45 terminates short of the limiting wall opposite to the exit opening 16 of the receiving nozzle duct 8.

What is claimed is:

1. A vacuum producing device comprising at least one ejector device, having a jet nozzle with a receiving nozzle placed downstream from it with a draw off zone defined in a transition zone between the jet nozzle and the receiving nozzle, a receiving space being present at an outlet end of the receiving nozzle, said receiving space serving for a fluid flowing through the receiving nozzle, an exit flow duct leading off from said space, means for influencing the fluid flow through the exit flow duct, wherein the exit flow duct's rated diameter as measured at a point minimum cross section of the exit flow duct is larger than the jet nozzle duct's rated diameter as measured at a minimum cross section of the jet nozzle duct and is smaller than the receiving nozzle duct's rated diameter as measured at a point of minimum cross section of the receiving nozzle duct.

2. A vacuum producing device as set forth in claim 1, wherein the exit flow duct's rated diameter is only slightly larger than the jet nozzle duct's rated diameter.

3. A vacuum producing device as set forth in claim 1, wherein the exit flow duct's rated diameter is smaller than the receiving nozzle duct's exit diameter.

4. A vacuum producing device for producing a vacuum associated with a fluid flow comprising:

a jet nozzle having an inlet opening for receiving the fluid flow;

a receiving nozzle having an outlet end and being placed downstream from said jet nozzle;

a draw off zone defining a transition between said jet nozzle and said receiving nozzle;

a receiving space located at said outlet end of said receiving nozzle;

an exit flow duct leading off from said receiving space and terminating at an exit flow opening; and a choke means for setting the volumetric fluid flow leaving through said exit flow duct to control a first pressure level within said receiving space, said choke means having a control member provided for said exit flow opening.

5. The vacuum producing device as set forth in claim 4, wherein said choke means is configured to steplessly set the volumetric fluid flow.

6. The vacuum producing device as set forth in claim 4, wherein said control member is placed in a position relative to said exit flow duct and said choke means is configured so that said position is adjustable.

7. The vacuum producing device as set forth in claim 6, wherein said choking means comprises a setting device which includes said control member, said setting device being electrically operable by application of a control voltage for adjusting said position of said control member.

8. The vacuum producing device as set forth in claim 7, wherein said setting device causes a deflection of said control member to adjust said position, said deflection being proportional to said control voltage.

9. The vacuum producing device as set forth in claim 8, wherein said setting device is configured to operate electromagnetically.

10. The vacuum producing device as set forth in claim 8, wherein said setting device is configured to operate piezoelectrically.

11. The vacuum producing device as set forth in claim 4, wherein said control member is located opposite said exit flow opening of said exit flow duct.

12. The vacuum producing device as set forth in claim 4, wherein dependent on the desired choke setting the control member is set nearer to or farther away from the exit flow opening.

13. The vacuum producing device as set forth in claim 4, wherein said exit flow duct is defined by an interchangeable exit flow nozzle.

14. The vacuum producing device as set forth in claim 4, wherein said exit flow duct is arranged so that the fluid flow exits into an atmosphere.

15. The vacuum producing device as set forth in claim 4, wherein said receiving nozzle defines a longitudinal direction and said exit flow duct is arranged to extend in said longitudinal direction.

16. The vacuum producing device as set forth in claim 4, wherein said receiving nozzle defines a longitudinal direction and said exit flow duct is arranged to be aligned laterally in relation to said longitudinal direction.

17. The vacuum producing device as set forth in claim 4, further comprising a control means for actuating said choke means based upon a second pressure level within said draw off zone.

18. The vacuum producing device as set forth in claim 17, wherein said control means includes a first pressure sensor for obtaining the second pressure level within said draw off zone.

19. The vacuum producing device as set forth in claim 18, wherein said control means includes a second pressure sensor for obtaining the first pressure level within said receiving space.

20. The vacuum producing device as set forth in claim 4, wherein said receiving space is formed by walls dimensioned to define an unobstructed supersonic flow zone at said outlet end of said receiving nozzle.

21. A vacuum producing device for producing a vacuum associated with a fluid flow comprising:

a jet nozzle having an inlet opening for receiving the fluid flow and being formed with a first duct having a first cross section, said first duct being defined by a first diameter, $d_S$, measured at a first point where said first cross section is a minimum;

a receiving nozzle having an outlet end and being placed downstream from said jet nozzle and being formed with a second duct having a second cross section, said second duct being defined by a second diameter, $d_F$, measured at a second point where said second cross section is a minimum;

a draw off zone defining a transition between said jet nozzle and said receiving nozzle;

a receiving space located at said outlet end of said receiving nozzle;

an exit flow duct having a third cross section and leading off from said receiving space to terminate at an exit flow opening, said exit flow duct being defined by a third diameter, $d_A$, measured at a third point where said third cross section is a minimum; and a choke means for setting the volumetric fluid flow leaving through said exit flow duct to control a first pressure level within said receiving space, said choke means having a control member provided for said exit flow opening, wherein said third diameter, $d_A$, is larger than said first diameter, $d_S$, and is smaller than said second diameter, $d_F$.

22. A vacuum producing device as set forth in claim 21, wherein said third diameter, $d_A$, is only slightly larger than said first diameter, $d_S$.

23. A vacuum producing device as set forth in claim 21, wherein said outlet end of said receiving space defines a fourth diameter, $D_1$, and said third diameter, $d_A$, is smaller than said fourth diameter, $D_1$.

* * * * *